United States Patent [19]

Tanaka et al.

[11] Patent Number: 4,938,176

[45] Date of Patent: Jul. 3, 1990

[54] MOUNTING STRUCTURE OF EGR VALVE FOR INTERNAL COMBUSTION ENGINE

[75] Inventors: Sojiro Tanaka; Yasuo Fukae, both of Kanagawa, Japan

[73] Assignee: Nissan Motor Company, Ltd., Kanagawa, Japan

[21] Appl. No.: 378,662

[22] Filed: Jul. 12, 1989

[30] Foreign Application Priority Data

Jul. 12, 1988 [JP] Japan ..... 63-92220[U]

[51] Int. Cl.[5] ..... F02M 35/10

[52] U.S. Cl. ..... 123/52 MC; 123/568

[58] Field of Search ..... 123/52 M, 52 MC, 52 MV, 123/568, 570

[56] References Cited

U.S. PATENT DOCUMENTS

| | | | |
|---|---|---|---|
| 3,915,128 | 10/1975 | Rich | 123/52 MV |
| 4,094,283 | 6/1978 | Sutton | 123/59 PC |
| 4,267,812 | 5/1981 | Aula et al. | 123/52 MV |
| 4,440,120 | 4/1984 | Butler | 123/52 MV |
| 4,466,389 | 8/1984 | Arkus-Duntov | 132/52 MV |
| 4,513,698 | 4/1985 | Senga et al. | 123/52 MV |
| 4,516,538 | 5/1985 | Arakawa et al. | 123/52 M |
| 4,708,097 | 11/1987 | Hatamura et al. | 123/52 M |

*Primary Examiner*—David A. Okonsky

*Attorney, Agent, or Firm*—Pennie & Edmonds

[57] ABSTRACT

A mounting structure for mouting an EGR valve on an intake maniford of an internal combustion engine is disclosed. The intake manifold includes a flange in which boltholes having internal threads are formed. The EGR valve is mounted on the flange by means of bolts. The flange includes a coolant passage inside. Coolant flows into this coolant passage from a cooling system of the engine to cool the boltholes effectively so as to prevent the bolts from loosening due to thermal fatigue of the internal thread portions caused by the high temperatures of recirculated exhaust gas.

6 Claims, 3 Drawing Sheets

MOUNTING STRUCTURE OF EGR VALVE FOR INTERNAL COMBUSTION ENGINE

BACKGROUND OF THE INVENTION

1. Technical Field

The present invention relates generally to a mounting structure for an EGR (Exhaust Gas Recirculation) valve for an internal combustion engine and more particularly to an improved mounting structure allowing an EGR valve to be directly installed on an intake manifold of an internal combustion engine.

2. Background Art

Recently, EGR valves for controlling the recirculation rate of exhaust gas redirected to the air intake system of internal combustion engines are frequently mounted directly on the intake manifold. A flange, for example, for installing an EGR valve is provided which is integrally formed on the intake manifold. The flange typically has internal threads. The EGR valve is mounted on the flange by tightening a bolt or a stud bolt into the internal threads.

Usually, an intake manifold for an internal combustion engine is casted of aluminum alloy and the flange for mounting the EGR valve is also made of the same material. The flange is subject to high temperatures due to the heat of exhaust gases flowing within the exhaust gas recirculation passage provided therein. This reduces the mechanical strength of the aluminum alloy. Thus, when the EGR valve is installed on the flange with bolts, the axial tension of bolts tends to cause the internal threads to deform due to continuous fatigue with the result that loosening of bolts occurs.

A water jacket provided so as to be arranged around the exhaust gas recirculation passage of the intake manifold has been proposed. However, the water jacket is adapted only for cooling exhaust gas. This water jacket, circulating a small amount of water, is not effective for cooling portions in the vicinity of the boltholes.

SUMMARY OF THE INVENTION

It is accordingly an object of the present invention to provide a mounting structure for mounting an EGR valve on an intake manifold without the bolts of the EGR valve loosening due to the high temperatures of the exhaust gas.

According to one aspect of the present invention, there is provided a mounting structure for mounting an EGR valve on an intake manifold of an internal combustion engine, which comprises a mounting portion integrally formed on the intake manifold, a hole formed in the mounting portion, into which a bolt is inserted to mount the EGR valve on the mounting portion, and a cooling passage, defined within the mounting portion, through which coolant flows to cool the hole so as to guard the hole against heat caused by exhaust gas recirculation.

In the preferred mode, the cooling passage may be defined in the mounting portion so as to pass proximate said hole to cool it effectively. Alternatively, the cooling passage may communicate with the hole so as to allow the coolant to flow thereinto.

Additionally, the hole may be plurality of boltholes having internal threads for engaging with the bolt. The boltholes are preferably provided parallel to each other. The cooling passage is directed perpendicularly to the axes of the boltholes.

DESCRIPTION OF THE PREFERRED EMBODIMENT

Figure 1:
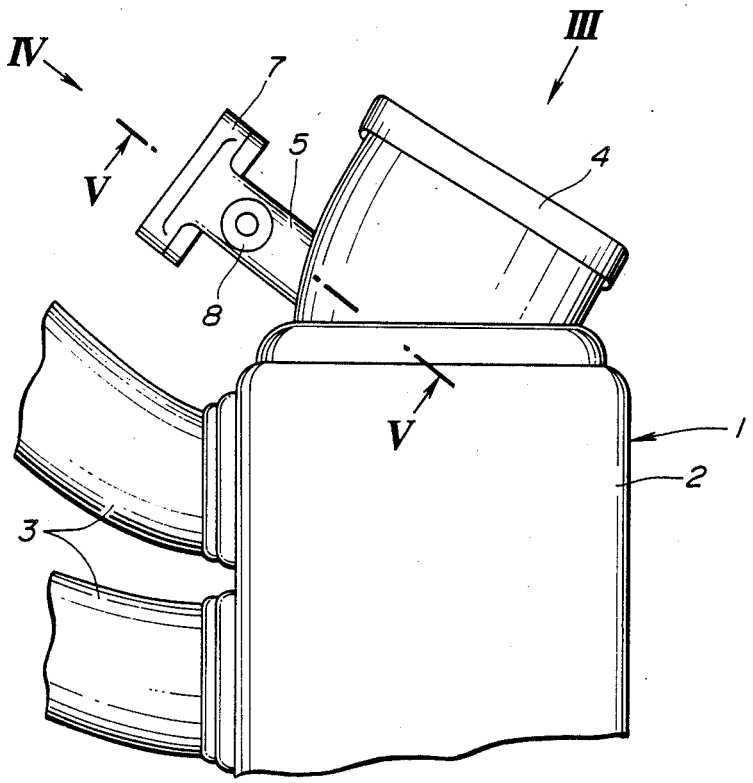
FIG. 1 is a plane view which shows a portion of an intake manifold, on which an EGR valve is mounted.
Figure 2:
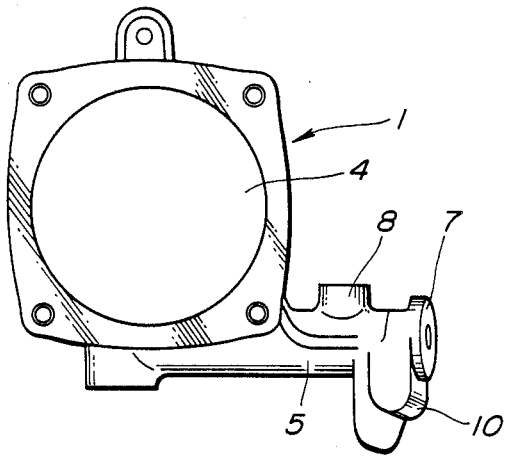
FIG. 2 is a view from arrow III in FIG. 1.

Referring now to the drawings, particularly to FIG. 1, a part of an intake manifold of an internal combustion engine, according to the invention, is shown. This intake manifold 1 includes a series of tubes 3 which are collected into a collecting portion 2 integrally formed of aluminum alloy for example. An EGR passage portion 5 is provided so as to project from an end of the collecting portion 2, that is, adjacent the outer surface of the air intake port 4. The EGR passage portion 5 has an exhaust gas recirculation passage 6 inside (see FIG. 4) and a substantially elliptically shaped flange 7 at its top end (see FIGS. 2 and 3). The EGR passage portion 5 further includes a boss 8 for mounting an exhaust gas temperature sensor (not shown). The flange 7 and the boss 8 are integrally casted with the intake manifold 1.

Figure 3:
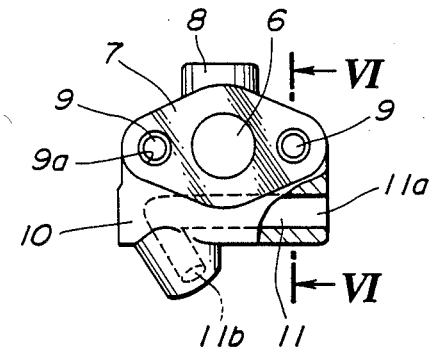
FIG. 3 is a view from arrow IV in FIG. 1.
Figure 4:
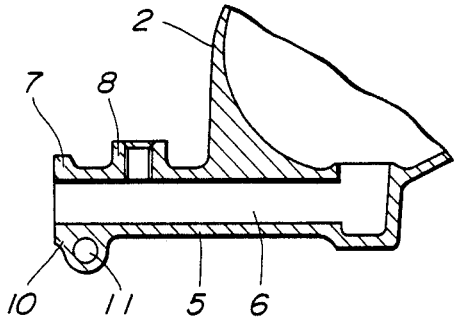
FIG. 4 is a sectional view taken along the line V—V in FIG. 1.
Figure 5:
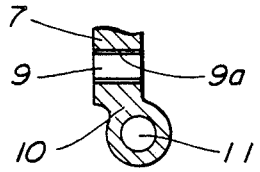
FIG. 5 is a sectional view taken along the line VI—VI in FIG. 3.

As shown in FIGS. 3 and 4, the exhaust gas recirculation passage 6 opens at the center of the flange 7 and boltholes 9 are arranged symmetrically with respect to that opening. These boltholes, as shown in FIG. 5, include internal threads 9*a*.

The EGR passage portion 5 further includes a coolant passage 11, adjacent to the flange 7, extending in the longitudinal direction thereof. A coolant inlet port 11*a* opens in the vicinity of one of the boltholes 9. From this position, the coolant passage 11 is directed toward the vicinity of the other bolthole 9 at right angles with respect to the axis of the boltholes and then curved at an acute angle so as to be directed downward in the drawing to provide an outlet 11*b*.

Figure 6:
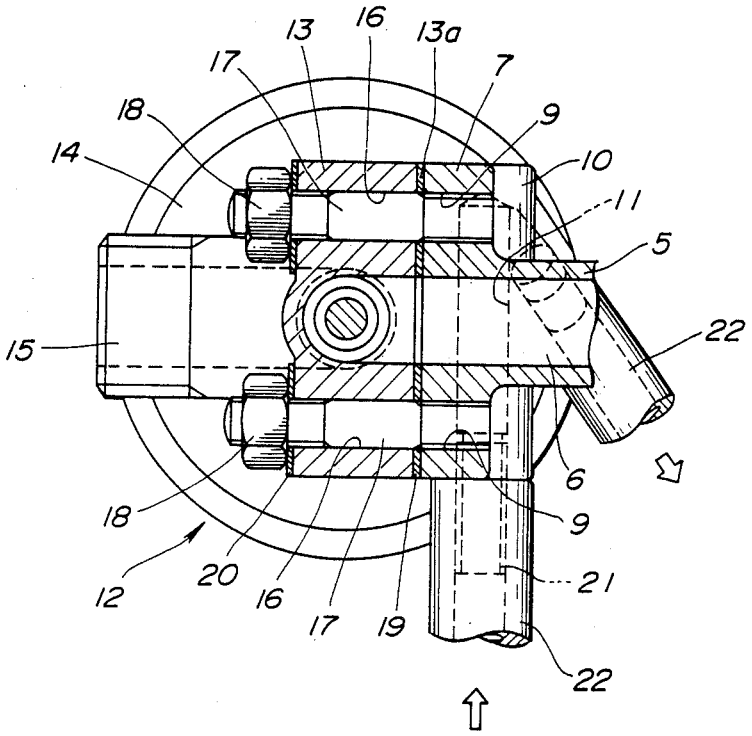
FIG. 6 is a sectional view which shows a mounting structure of an EGR valve, according to the present invention.

Referring to FIG. 6, an EGR valve 12 attached on the above described flange 7 is shown. The EGR valve 12 generally includes a body 13, a disc type diaphragm 14, and a connecting portion 15 having threads. An EGR tube is connected to this portion 15 to supply exhaust gas. The body 13 has a flat face 13*a*, corresponding to the flange 7, in which a pair of through holes 16 are formed as boltholes corresponding to the boltholes 9 associated with the flange 7. This EGR valve is actuated by engine vacuum. During throttle operations other than full throttle or engine idling, the vacuum causes the valve to raise its diaphragm and open the port. This allows some of the exhaust gas to enter the intake manifold. The exhaust gas reduces combustion temperatures and thus the amount of $NO_x$ coming out the tail pipe.

One end of the stud bolts 17 is screwed into the boltholes 9 of the flange 7 and the other ends are respectively inserted into through holes 16 of the EGR valve 12. By tightening nuts 18 onto the stud bolts, the body 13 is connected to the flange 7. Flat washers 20 are interposed between the nuts 18 and the stud bolts 17.

Additionally, a gasket 19 is interposed between the flat face 13*a* and the flange 7.

Metal pipes 21 are pressed so as to fit hermetically into the coolant inlet port 11*a* and the coolant outlet port 11*b* respectively. In addition, each metal pipe 21 couples with coolant hoses 22 to and from the flange 7. The coolant hoses are communicated to the cooling system of the engine.

In the above structure, the forced flow of engine coolant in the coolant passage 11 causes the portions in the vicinity of the boltholes 9 of the flange 7 to be cooled, thereby preventing the mechanical strength of the internal threads 9*a* from being reduced due to fatigue induced by extremely high temperatures. Therefore, loosening of the stud bolt 17 due to deformation of the internal threads 9*a* caused by thermal fatique does not occur. Particularly, in the above mentioned structure of a mounting portion for an EGR valve, since the flow of the coolant is directed perpendicularly to the axis of the boltholes 9, the provision of an extremely small space for the coolant passage is sufficient to enable a pair of boltholes to be cooled efficiently. Additionally, local cooling only in the vicinity of the boltholes will be effective while requiring only a small amount of coolant.

It will be noted that the provision of a coolant passage communicating with the boltholes to directly contact the coolant with the stud bolts 17 is possible. In this structure, sealing around the stud bolts through the application of a sealant is preferably necessary.

Moreover, in the above embodiment, while the EGR valve is fixed by stud bolts 17 and nuts 18, the invention is also applicable to an EGR valve fixed by other means as well.

As is clear from the above description, of a mounting structure for an EGR valve for an internal combustion engine according to the invention, forced coolant flow is provided in the vicinity of the boltholes of the mounting flange, preventing temperatures around the boltholes from rising excessively. Thus, even in an intake manifold made of a material such as aluminum alloy, which has low mechanical strength at high temperatures, loosening of the stud bolts due to permanent fatique of the internal threading does not occur.

What is claimed is:

1. A mounting structure for mounting an EGR valve on an intake manifold of an internal combustion engine comprising:

a mounting portion integrally formed on the intake manifold;

a hole formed in said mounting portion, into which a bolt is inserted to mount the EGR valve on said mounting portion; and a cooling passage, defined within said mounting portion, through which coolant flows to cool said hole so as to guard said hole against heat caused by exhaust gas recirculation.

2. A mounting structure as set forth in claim 1, wherein said cooling passage is defined in said mounting portion so as to pass proximate said hole to cool it effectively.

3. A mounting structure as set forth in claim 2, wherein said hole is plurality of boltholes having internal threads.

4. A mounting structure as set forth in claim 2, wherein said cooling passage is directed perpendicularly to the axis of said hole.

5. A mounting structure as set forth in claim 3, wherein said boltholes are provided parallel to each other, said cooling passage being directed perpendicularly to the axes of said boltholes.

6. A mounting structure as set forth in claim 1, wherein said cooling passage communicates with said hole so as to allow the coolant to flow thereinto.

* * * * *